US006474234B1

(12) United States Patent
Rothaug

(10) Patent No.: US 6,474,234 B1
(45) Date of Patent: Nov. 5, 2002

(54) METHOD FOR LOCKING A CYLINDER DRESSING ON A PRINTING MACHINE CYLINDER

(75) Inventor: Jürgen Rothaug, Nussloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/553,327

(22) Filed: Apr. 20, 2000

(30) Foreign Application Priority Data

Apr. 20, 1999 (DE) ..... 199 17 912

(51) Int. Cl.[7] ..... B41F 27/12
(52) U.S. Cl. ..... 101/415.1; 101/378
(58) Field of Search ..... 101/415.1, 378, 101/409

(56) References Cited

U.S. PATENT DOCUMENTS

| | | | | |
|---|---|---|---|---|
| 1,821,713 A | | 9/1931 | Johansen | 493/360 |
| 2,229,487 A | | 1/1941 | Barber | 493/359 |
| 2,335,431 A | | 11/1943 | Meyer | 270/43 |
| 3,180,007 A | | 4/1965 | Gartz | 492/38 |
| 3,795,193 A | * | 3/1974 | Johne et al. | 101/415.1 |
| 4,349,195 A | | 9/1982 | Small et al. | 270/32 |
| 5,029,829 A | | 7/1991 | von Hein et al. | 270/47 |
| 5,466,212 A | | 11/1995 | Springer | 493/434 |
| 5,904,097 A | * | 5/1999 | Nishi | 101/415.1 |

FOREIGN PATENT DOCUMENTS

| | | |
|---|---|---|
| DE | 2 105 633 | 8/1972 |
| DE | 2 200 187 | 8/1972 |
| DE | 42 08 320 A1 | 6/1993 |
| DE | 43 30 024 A1 * | 3/1995 |
| DE | 41 34 365 C2 | 12/1998 |
| DE | 41 34 309 C2 | 3/1999 |

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A method for locking a cylinder dressing on a printing machine cylinder, including adjusting a first clamping bar for holding the cylinder dressing, and a second clamping bar for likewise holding the cylinder dressing, towards one another in respective tautening directions thereof, further includes adjusting the two clamping bars by actuating the same adjusting member, so that, when locking the cylinder dressing, in a first method step, only the first clamping bar is adjusted and, in a second method step, the two clamping bars are adjusted simultaneously, a device for performing the method, and a printing machine including the device.

6 Claims, 4 Drawing Sheets

METHOD FOR LOCKING A CYLINDER DRESSING ON A PRINTING MACHINE CYLINDER

BACKGROUND OF THE INVENTION

Field of the Invention

The invention relates to a method for locking or clamping a cylinder dressing on a printing machine cylinder, which includes adjusting a first locking or clamping bar for firmly holding the cylinder dressing and a second locking or clamping bar for likewise holding the cylinder dressing, towards one another in a respective tensioning or tautening direction thereof, and to two devices for locking a cylinder dressing on a printing machine cylinder, with a first locking or clamping bar and a second locking or clamping bar.

Such a device is described in the published German Non-prosecuted Patent Application (DE-OS) 21 05 633. In this heretofore known device, a locking or clamping bar for a starting end of a printing plate is displaceable by a screw, and a locking or clamping bar for the ending end of the plate is displaceable by another screw. In practice, however, a single screw for the plate start and a single screw for the plate end are insufficient for uniformly tautening the printing plate over the width or breadth thereof. A respective plurality of screws are arranged next to one another and are tightened in succession by the pressman at the plate start and the plate end, as illustrated in FIG. 3 of the German non-prosecuted application. The multiplicity of operating locations not only make it more difficult to operate the device manually, but also makes it virtually impossible for the device to be automated.

Another such device is described in the published German Prosecuted Application (DE-AS) 22 00 187. In this device, a plurality of adjusting bolts brace a front locking bar against a cylinder gap wall. For locking up a printing plate, the first locking bar is displaced by the adjusting bolts, so that a leading edge of lay marks coincides with a neutral position. The adjustment of the adjusting bolts to be performed in succession by the pressman is similarly as time-consuming as the tightening of the screws of the device described in The published German Non-prosecuted Patent Application (DE-OS) 21 05 633 noted hereinbefore. After the adjusting bolts have been adjusted, the printing-plate leading edge is laid against the leading edge of the lay marks and tightly clamped, and only then is the printing-plate trailing edge introduced into a rear locking bar and tightly clamped. A disadvantage thereof is that no assurance is provided of uniform tautening of the printing plate in the circumferential direction of the plate cylinder, because it is not possible, with this device, to clamp or lock up the printing plate at both ends thereof. So that the neutral position set before tautening is not lost, during the tautening, the printing-plate leading edge is held locally fixed and only the printing-plate trailing edge is pulled. In the case of many printing plates, the somewhat rope-frictionlike effect active between the printing plates and the plate cylinder, cannot be overcome by the clamping at one end, as described, because the tautening or tensioning forces capable of being exerted upon the printing plate are limited by the construction, and because of the risk of tearing or breaking the printing plate.

The published German Patent Document DE 41 34 309 C2 describes a device for positionally accurate quick-action clamping or locking-up a flexible printing plate on a plate cylinder. A front clamping or locking bar of this device is connected laterally to an actuating device formed of a threaded member and a crank fixedly connected thereto. The front clamping or locking bar is displaceable by a thread of the threaded member. The threaded member is not displaceable in a direction axially parallel with the plate cylinder.

The published German Patent Document DE 41 34 365 C2 describes a further device for positionally accurate quick-action clamping or locking-up a flexible printing plate on a plate cylinder. A front clamping bar of the device described in this reference has assigned thereto, in the middle thereof, a center of rotation fixedly disposed in a cylinder gap and, laterally, an actuating device fastened to a machine frame. The actuating device, via an eccentric disposed on a roller lever, engages in an opening formed in a front lower bar, whereon a front clamping bar is fastened. Neither the eccentric nor the roller lever is displaceable in a direction axially parallel to the plate cylinder.

By the devices described in the two last-mentioned German patent documents, namely DE 41 34 309 C2 and DE 41 34 365 C2, therefore, it is not possible to eliminate satisfactorily the disadvantages inherent in the devices described in the two first-mentioned German patent documents, namely the Non-prosecuted Application (DE-OS) 21 05 633 and the Prosecuted Application (DE-AS) 22 00 187.

The German Patent Document DE 42 08 320 A1 describes a method for correcting skewed positions of flexible printing plates on a plate cylinder. According to this method, a rear clamping or locking bar is loosened or unclamped, the position of a front clamping or locking bar is corrected and the rear clamping or locking bar is thereafter reclamped. It is necessary, in this method, to roll a pressure roller or a backup cylinder over the printing plate after the position of the front clamping bar has been corrected. This is time-consuming and presupposes the presence of a pressure roller or a backup cylinder suitable for the purpose.

SUMMARY OF THE INVENTION

It is accordingly an object of the invention to provide a method for locking a cylinder dressing on a printing machine cylinder that is quick-acting and avoids the foregoing disadvantages of heretofore known methods of this general type, and to provide at least one device having few operating locations and by which the method may be performed.

With the foregoing and other objects in view, there is provided, in accordance with one aspect of the invention, a method for locking a cylinder dressing on a printing machine cylinder, including adjusting a first clamping bar for holding the cylinder dressing, and a second clamping bar for likewise holding the cylinder dressing, towards one another in respective tautening directions thereof, which comprises adjusting the two clamping bars by actuating the same adjusting member, so that, when locking the cylinder dressing, in a first method step, only the first clamping bar is adjusted and, in a second method step, the two clamping bars are adjusted simultaneously.

In accordance with another mode, the method of the invention includes adjusting the two clamping bars towards one another simultaneously, while adjusting the adjusting member in an adjusting direction axially parallel to the printing machine cylinder.

In accordance with a further mode, the method of the invention includes, during tautening, holding the cylinder dressing at the trailing edge thereof by the first clamping bar and at the leading edge thereof by the second clamping bar.

In accordance with a second aspect of the invention, there is provided a device for locking a cylinder dressing on a printing machine cylinder, with a first clamping bar and a second clamping bar, comprising at least one adjusting member adjustable in an adjustment direction axially parallel to the printing machine cylinder for adjusting the two clamping bars in a respective tautening direction thereof, the second clamping bar being supported on the printing machine cylinder via an adjustable stop.

In accordance with another feature of the invention, the adjustable stop is rotatable out of a blocking rotary position wherein the adjustable stop blocks an adjustment of the second clamping bar, into a released rotary position wherein the adjustable stop enables the adjustment of the second clamping bar.

In accordance with a further feature of the invention, the adjustable stop is a two-position eccentric.

In accordance with an added feature of the invention, the first clamping bar is supported on the printing machine cylinder via a spring.

In accordance with a third aspect of the invention, there is provided a device for locking a cylinder dressing on a printing machine cylinder, with a first clamping bar and a second clamping bar, comprising at least one adjusting member adjustable in an adjusting direction axially parallel to the printing machine cylinder for adjusting the two clamping bars in a respective tautening direction thereof, and together therewith forming a floating system supported on the printing machine cylinder via a spring.

In accordance with another feature of the invention, a trailing edge of the cylinder dressing is fastenable to the first clamping bar, and the spring is interposed between the first clamping bar and the printing machine cylinder, so that the spring force of the spring acts upon the first clamping bar in the tautening direction thereof.

In accordance with a further feature of the invention, a leading edge of the cylinder dressing is fastenable to the second clamping bar, and the spring is interposed between the second clamping bar and the printing machine cylinder, so that the spring force of the spring acts upon the second clamping bar counter to the tautening direction thereof.

In accordance with an added feature of the invention, the first clamping bar is supported on the second clamping bar via another spring.

In accordance with an additional feature of the invention, the other spring has a more rigid action than the first-mentioned spring.

In accordance with yet another feature of the invention, the device includes at least one thrust wedge formed on each of the two clamping bars, the adjusting member being pressable during the adjustment thereof on the at least one thrust wedge for thereby adjusting the clamping bars in the tautening direction thereof.

In accordance with yet a further feature of the invention, the adjusting member is an adjusting crossmember displaceable in the axially parallel direction.

In accordance with a third aspect of the invention, there is provided a printing machine having at least one device for locking a cylinder dressing on a cylinder thereof, the device having a first clamping bar and a second clamping bar, and comprising at least one adjusting member adjustable in an adjustment direction axially parallel to the printing machine cylinder for adjusting the two clamping bars in a respective tautening direction thereof, the second clamping bar being supported on the printing machine cylinder via an adjustable stop.

In accordance with a concomitant feature of the invention, the one adjusting member is capable of adjusting both of the clamping bars.

In accordance with an alternative feature of the invention, the at least one adjusting member constitutes an individual adjusting member for each of the first and the second clamping bars.

The pressman, when performing the method according to the invention, is no longer required to tighten a large number of screws or to adjust any adjusting bolts, but instead, effects a quick-action tautening of the cylinder dressing essentially by a single actuation of the adjusting member. The adjustment of the adjusting member and, if appropriate, an additional adjustment of an adjustable stop can be effected without difficulty by an electromotive or pressure fluid-loadable remotely controllable adjusting or setting drive, so that the method can be performed not only manually, but also in a completely or partially automated manner.

Despite the pulling or drawing of the two dressing edges, the positional accuracy of the cylinder dressing is always assured when it is subjected to tension at both ends and is therefore uniformly taut in the circumferential direction. For this purpose, in the second method step, the clamping bars can be adjusted towards one another in the respective tensioning or tautening direction and relative to the printing machine cylinder over adjustment paths which differ in length from one another.

The two devices according to the invention are based upon the same principle, as explained hereinbelow.

The first device according to the invention for clamping or locking a cylinder dressing on a printing machine cylinder, with a first clamping bar and a second clamping bar, is distinguished in that the two clamping bars are adjustable in the respective tautening or tensioning direction thereof by the same or a respective adjusting member adjustable in an adjusting direction axially parallel to the printing machine cylinder, and the second clamping bar is supported on or braced against the printing machine cylinder via an adjustable stop.

This device has only a few operating locations in the form of a single adjusting member or of two adjusting members, plus the adjustable stop, and is very suitable for effectively performing the method according to the invention. In this regard, the device functions in a manner that, in the first method step, only the first clamping bar is adjusted in the tautening or tensioning direction thereof relative to the printing machine cylinder and, in the second method step, both clamping bars are adjusted in the tensioning direction thereof relative to the printing machine cylinder, in the second method step the second clamping bar being adjusted over a longer adjustment path than the first clamping bar.

Successive adjustment of the clamping bars is achieved by the adjustment of the adjustable stop taking place between the method steps. After the adjustable stop has been released, the two clamping bars are adjustable as a unit in the form of a so-called floating lock-up system.

A second device according to the invention for the clamping or locking up a cylinder dressing on a printing machine cylinder, with a first clamping bar and a second clamping bar, is distinguished in that the two clamping bars are adjustable in the respective tensioning or tautening direction thereof by the same or a respective adjusting member adjustable in an adjusting direction axially parallel to the printing machine cylinder and together form a floating system supported on or braced against the printing machine cylinder via a first spring.

This device, too, has only a few operating locations in the form of the common adjusting member or the respective adjusting members, as the case may be, and is likewise very suitable for effectively performing the method according to the invention.

In this regard, the device functions so that, in the first method step, the first clamping bar is adjusted in the tensioning or tautening direction thereof relative to the printing machine cylinder and the second clamping bar is not adjusted, and so that, in the second method step, the second clamping bar is adjusted over a greater adjustment travel distance than the first clamping bar.

In this context, the staggered adjustment of the clamping bars is effected by the first spring which, during the first method step, temporarily fixes the second clamping bar in the position thereof, until the force acting on the first spring exceeds a specific amount, with the result that the first spring is tensioned or tautened, and the second clamping bar is therefore also adjusted in the tensioning or tautening direction thereof.

Both in the first and the second device according to the invention, provision may be made for the two clamping bars to have a common adjusting member assigned thereto that is adjustable in the axially parallel adjusting direction. Provision may also be made, in both devices, for the first clamping bar to have a first adjusting member assigned thereto that is adjustable in an adjusting direction axially parallel to the printing machine cylinder and for the second clamping bar to have assigned thereto just such an adjusting member for adjusting the respective clamping bar in a tensioning or tautening direction. The method and the devices are particularly suitable for the in-register clamping or locking-up of a varnishing or printing plate on a form cylinder of a rotary printing machine.

Other features which are considered as characteristic for the invention are set forth in the appended claims.

Although the invention is illustrated and described herein as embodied in a method and device for locking or clamping a cylinder dressing on a printing machine cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
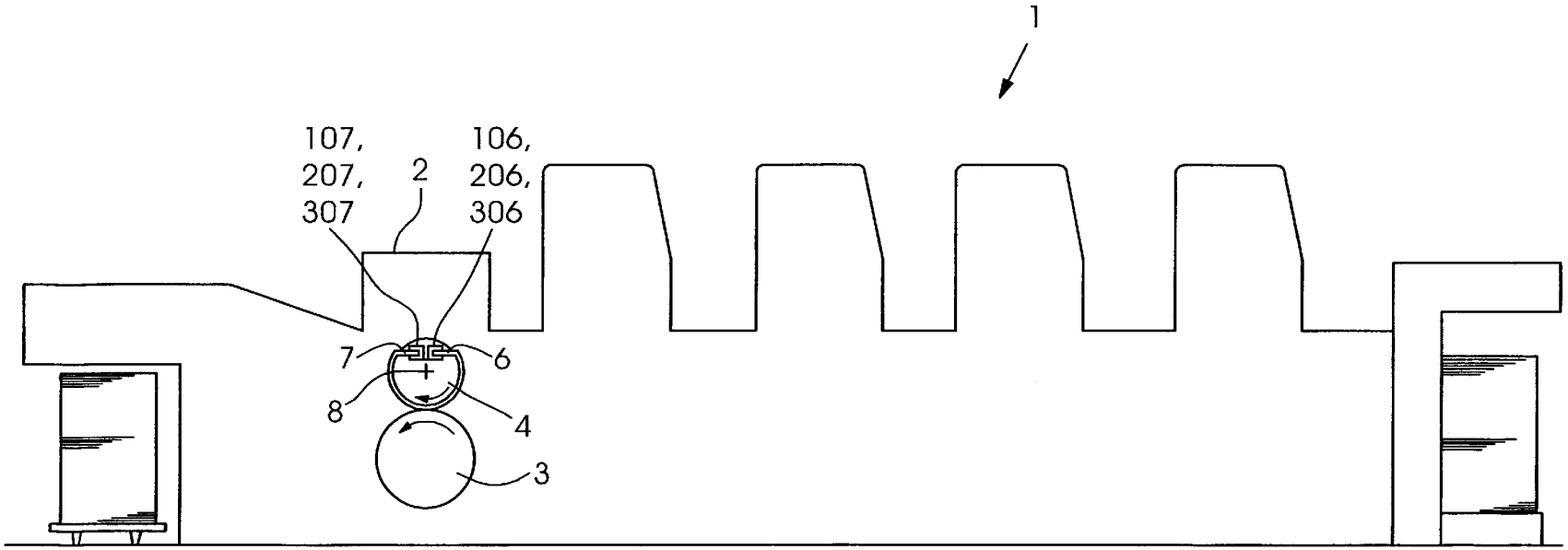
FIG. 1 is a diagrammatic side elevational view of a printing machine with a printing machine unit having a printing machine cylinder with a cylinder dressing clamped thereon in accordance with the method and device of the invention.

Referring now to the drawings and, first, particularly to FIG. 1 thereof, there is shown therein a printing machine 1 with a printing machine unit 2 in the form of a varnishing unit located downline of a plurality of sheet-fed offset printing units. The printing machine unit 2 includes a printing machine cylinder 3 in the form of a print-carrier guiding impression cylinder, and a printing machine cylinder 4 in the form of a varnish-guiding coating cylinder assigned to the impression cylinder. A cylinder dressing 5 in the form of a varnish plate is tautly clamped on the circumference of the printing machine cylinder 4. The cylinder dressing 5 has a trailing edge 6 that is fastened by clamping or locked at a first clamping or locking bar 106, 206 and 306, and a leading edge 7, in the vicinity of which the print start is located and which is fastened by clamping or locked at a second clamping or locking bar 107, 207 or 307. Three embodiments of clamping or lock-up devices, respectively, formed of the two clamping or locking bars 106, 107 or 206, 207 or 306, 307 and suitable in like manner for equipping the printing machine cylinder 4 are described hereinbelow.

Figure 2:
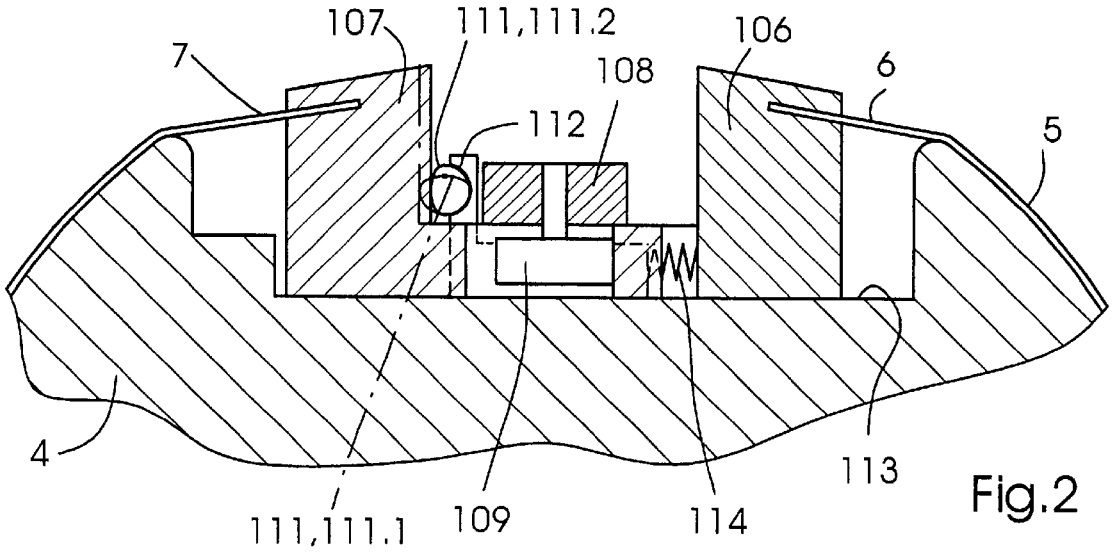
FIG. 2 is an enlarged fragmentary sectional view (according to line II—II in FIG. 3) of FIG. 1 showing a first embodiment of a lock-up device for the printing machine cylinder, according to the invention.
Figure 3:
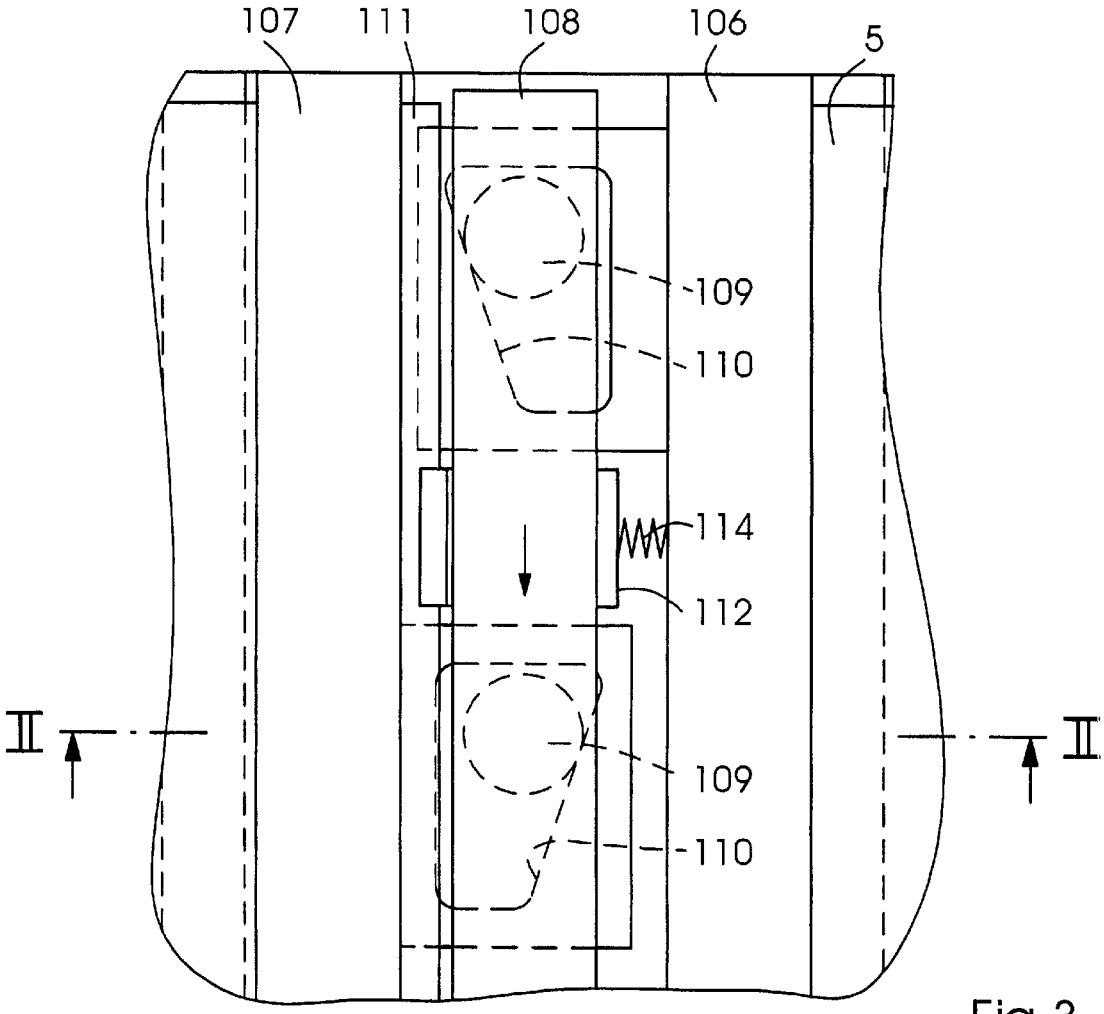
FIG. 3 is a fragmentary top plan view of FIG. 2.

In a first exemplary embodiment illustrated in FIGS. 2 and 3, the clamping bars 106 and 107 are mounted on a guide face 113 forming a secant of the printing machine cylinder 4 and located in the cylinder gap of the printing machine cylinder 4, so as to be displaceable linearly towards and away from one another. An adjusting member 108 formed as a bar-shaped adjusting crossmember, and being slidable into and being withdrawable from the printing machine cylinder 4 in a direction parallel to an axis of rotation 8 of the cylinder 4 (note FIG. 1) serves for adjusting the clamping bars 106 and 107 in a direction towards to one another. Advantageously, if it is possible to adjust the adjusting member 108 manually, the pressman is required to operate the clamping or locking device only from the operating side of the printing machine 1.

For a smooth adjustment of the clamping bars 106 and 107, cam rollers 109 are rotatably mounted in the adjusting member 108 and, during the displacement of the adjusting member 108, roll, in the tensioning or tautening direction represented by an arrow in FIG. 3, on faces of thrust wedges 110 extending obliquely to the axis of rotation 8. The thrust wedge 110 formed in a projection of the clamping bar 106, and the thrust wedge 110 formed in a projection of the clamping bar 107 rise at a small angle in the tensioning or tautening direction of the adjusting member 108 towards the respective clamping bar 106 and 107, respectively, thereof. Preferably, a plurality of thrust wedges 110 for the edgewise-free displacement of the clamping bars 106 and 107 are formed on each clamping bar 106 and 107.

It is also conceivable to form the thrust wedges 110 on the adjusting member 108 and to fasten at least one cam roller 109 to the clamping bar 106 and likewise at least one cam roller 109 to the clamping bar 107. In this interchanged arrangement, too, as a result of rolling friction reducing the wear of the thrust parts 110, high tensioning or tautening forces can be transmitted to the clamping bars 106 and 107 via the adjusting member 108. Both in the case of a thrust wedge 110 arranged on a clamping bar 106 or 107 and in the case of a thrust wedge 110 formed on a adjusting member 108, it is conceivable, for many applications, that instead of the cam roller 109, a sliding shoe presses onto the thrust wedge 110 and the thrust wedge 110 presses onto the sliding-shoe, respectively.

The second clamping bar 107 is supported, via an adjustable stop 111 rotatable about the axis thereof axially parallel to the axis of rotation 8, on a stop 112 which, relative to the printing machine cylinder 4, is frame-fixed. The stop 111, which is adjustable in an operationally reliable manner, is formed as an eccentric shaft that is rotatable selectively into a first rotary position 111.1 or into a second rotary position 111.2 rotated approximately through 90° relative to the first rotary position 111.1, and has the form of a round profile rod flattened on the circumference thereof, for example, 1 millimeter in the radial direction. The frame-fixed stop 112 is a bracket of approximately L-shaped profile, interposed in the axial direction between the thrust wedges 110 of the two clamping bars 106 and 107 in the cylinder gap and fastened to the printing machine cylinder 4 by screws and has, on a vertical bar, a guide trough for the adjustable stop 111, the guide trough facing the second clamping bar 107. At least one helical and pressure-loaded spring 114 serves for returning the first clamping bar 106 and is supported equally on the printing machine cylinder 4 and on the first clamping bar 106, for which purpose the spring 114 is inserted, in prestressed condition, between the frame-fixed stop 112, more precisely the horizontal bar thereof, and the first clamping bar 106.

It is conceivable to have as the adjustable stop 111, instead of the eccentric shaft, a screw that is adjustable in the tautening direction of the clamping bar 107, the axis of rotation of the screw lying perpendicularly to the axis of rotation 8 and parallel to the guide face 113. The screw may be rotatable, for example, in a thread formed in the bracket.

The performance of the locking method by the lock-up device is described hereinbelow. After the cylinder dressing 5 has been clamped at both edges in the clamping bars 106 and 107, the adjusting member 108 is pushed in the direction represented by the arrow, so that the first clamping bar 106 is pulled in the tensioning or tautening direction, counter to the action of the spring 114, towards the second clamping bar 107 remaining in the position thereof.

After the trailing edge 6 has thereby been clamped, the adjustable stop 111 is rotated out of the first rotary position 111.1 thereof, blocking an adjustment of the second clamping bar 107 in the tautening direction, into the second rotary position 111.2 thereof, so that, during further displacement of the adjusting member 108 in the axial tautening direction thereof, the second clamping bar 107 can move up in the tautening direction thereof, with the result that the leading edge 7 is clamped.

Due to the increasing resistance of the spring 114 to the adjustment of the first clamping bar 106 in the tautening direction thereof, after the adjustable stop 111 has been released, the first clamping bar 106 is then adjusted only insignificantly and the second clamping bar 107 is adjusted in a tautening direction over a greater adjustment travel distance than that of the first clamping bar 106, until the print start of the cylinder dressing 5 has reached a position necessary for an accurate circumferential register. By self-locking of a gear displacing the adjusting member 108 in the tautening direction thereof or by an additional locking device, the position of the adjusting member 108 and consequently the maintenance of the clamping at both the leading and trailing edges 6 and 7 of the cylinder dressing are assured.

In order to release or loosen the clamping of the dressing, the adjusting member 108 is displaced in a direction that is opposite to the tautening direction represented by the arrow in FIG. 3. It is thereby possible for the spring 114 to adjust the first clamping bar 106 in the direction opposite to the tautening direction, and the adjustable stop 111 can be rotated out of the second rotary position 111.2 thereof with a small effective supporting width back into the first rotary position 111.1 thereof with a large effective supporting width, with the result that the second clamping bar 107 is returned.

Figure 4:
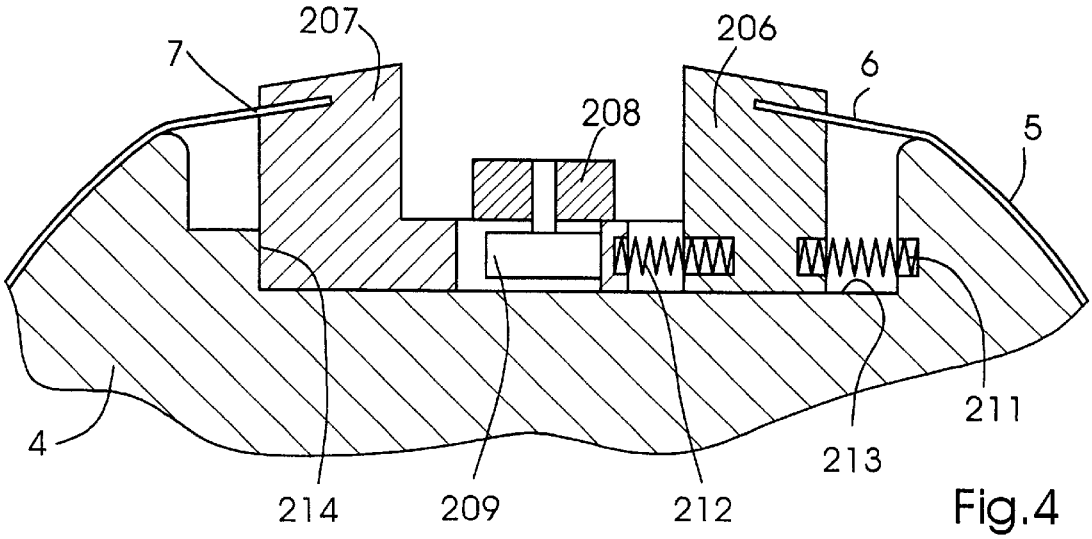
FIG. 4 is a view (according to line IV—IV in FIG. 5) like that of FIG. 2 of a second embodiment of the lock-up device for the printing machine cylinder, according to the invention.
Figure 5:
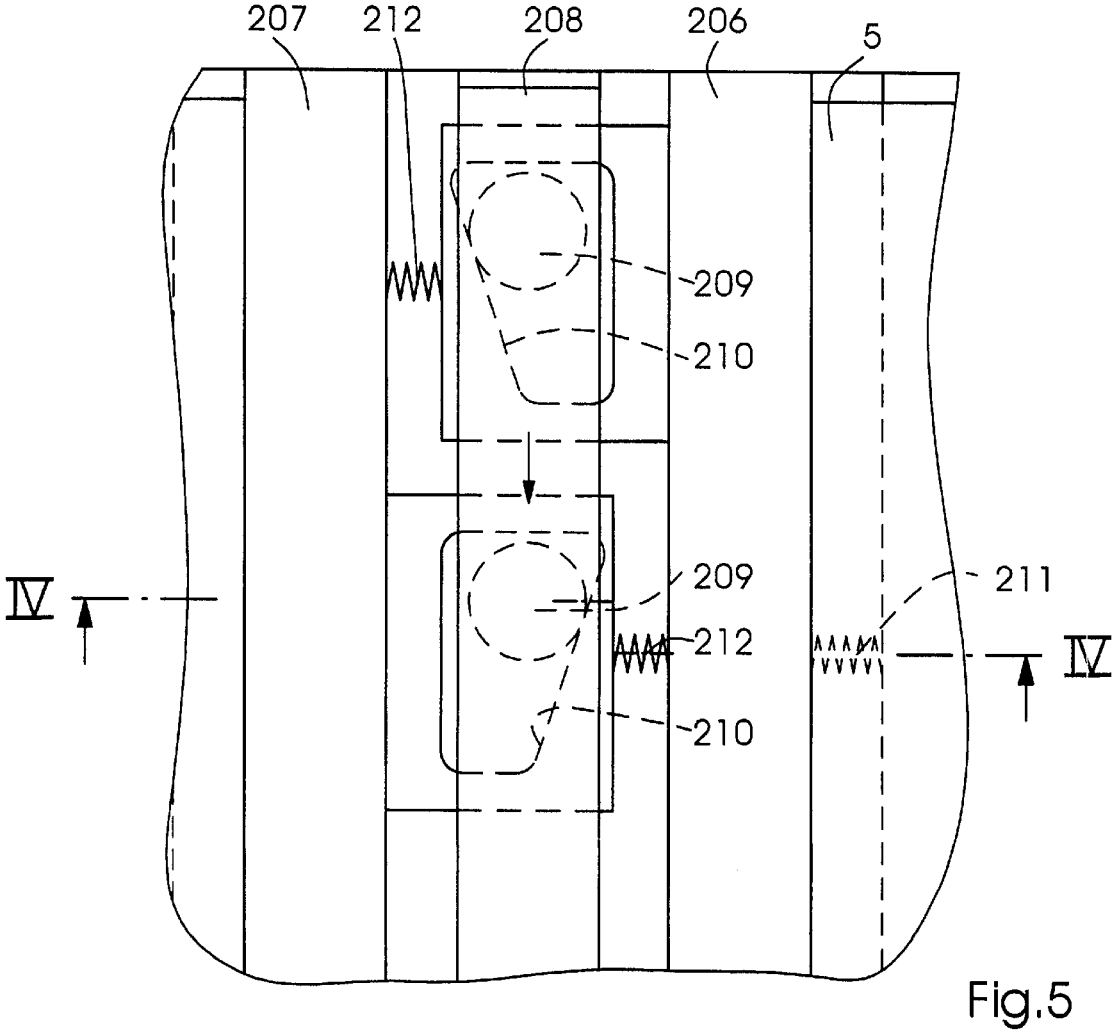
FIG. 5 is a fragmentary top plan view of FIG. 4.

FIGS. 4 and 5 illustrate a locking or clamping device which is an alternative to the first exemplary embodiment described hereinabove and which corresponds to the first exemplary embodiment in terms of the fastening of the cylinder dressing 5 to the clamping bars 206 and 207 and in terms of the adjustment thereof by the adjusting member 208 via the cam rollers 209 and the thrust wedges 210. Because the parts 206 to 210 and guide face 213 correspond to the parts 106 to 110 and guide face 113, there is no need particularly to discuss the construction and functioning of the first-mentioned parts again, and only material and functional features different from the first exemplary embodiment of FIGS. 2 and 3 will be dealt with in the second exemplary embodiment of FIGS. 4 and 5.

In the second exemplary embodiment, the staggered adjustment of the clamping bars 206 and 207 is not effected by an adjustable stop, but by at least one helical and pressure-loadable first spring 211. The first spring 211 is braced against both the first clamping bar 206 and the printing machine cylinder 4 and is inserted, prestressed, into receiving bores formed in the first clamping bar 206 and in the rear cylinder-gap wall located opposite the first clamping bar 206. At least one helical and pressure-loadable second spring 212 is interposed in a comparable manner between the clamping bars 206 and 207 for returning them in opposite directions. The spring constant of the second spring 212 is higher than the spring constant of the first spring 211. In the presence of a plurality of parallel-acting second springs 212 and/or a plurality of parallel-acting first springs 211, the overall spring constant or overall spring rigidity of all the second springs 212 which are present is higher than the overall spring constant or overall spring rigidity of all the first springs 211 which are present.

When the adjusting member 208 is displaced in the axially parallel tautening direction thereof represented by an arrow, initially only the first clamping bar 206 is adjusted in the tautening direction thereof, because the entire floating system, formed of the clamping bars 206 and 207, the adjusting member 208 mounted thereon and the second spring 212, is held by the action of the first spring 211 against a steplike frame-fixed stop 214 on the front inner wall of the cylinder gap. In other words, the first spring 211 presses onto the second spring 212 via the first clamping bar 206. Because the second spring 212 is comparatively rigid, it is compressed only insignificantly and transmits the pressure of the expanding first spring 211 to the second clamping bar 207 which is thereby held against the stop 214 formed on or fastened to the basic cylinder body. In a non-illustrated embodiment, the stop 214 being also adjustable in and opposite to the tautening direction of the second clamping bar 207 and being fixable in the adjusted position. It is thereby possible to achieve an adaptation of the position of the second clamping bar 207, in which position the leading edge 7 is held and the print start is thus defined, to elastic dressing materials different from one another and to an adjustment of the circumferential register.

With an increasingly tautened trailing edge 6, during the further displacement of the adjusting member 208, the second spring 212 is compressed, so that the second clamping bar 207, too, is displaced, the leading edge 7 held by the latter is tautened and the print start located on the leading edge is finely adjusted according to a correct circumferential register, the second clamping bar 207 being adjusted in the tautening direction thereof relative to the printing machine cylinder 4 more than the first clamping bar 206.

The clamping or locking of the cylinder dressing 5 is released by pushing the adjusting member 208 back again, with the result that it is possible for the second spring 212 interposed between the clamping bars 206 and 207 to return the clamping bars 206 and 207 to the previous position thereof.

Figure 6:
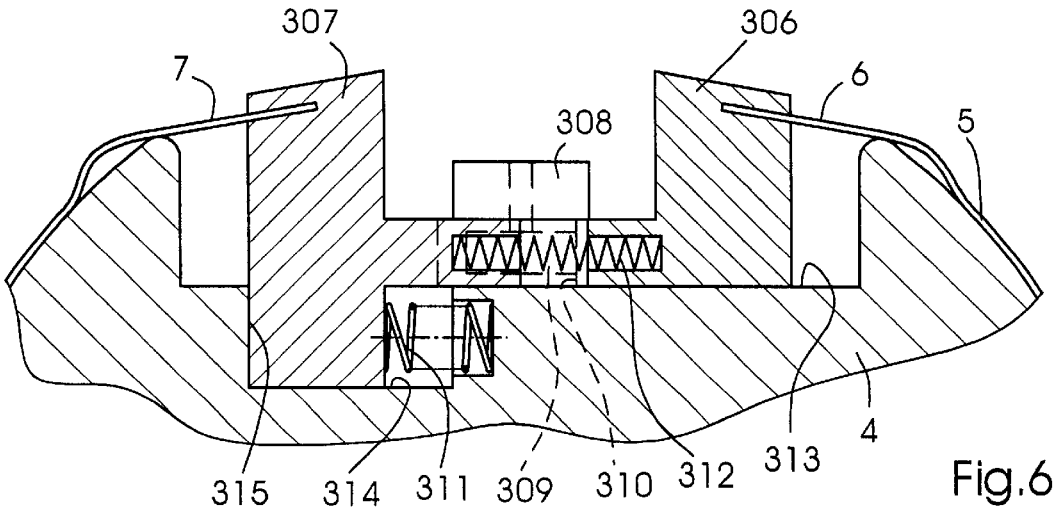
FIG. 6 is a view like those of FIGS. 2 and 4 of a third embodiment of the lock-up device for the printing machine cylinder, the lock-up device holding the cylinder dressing unclamped.
Figure 7:
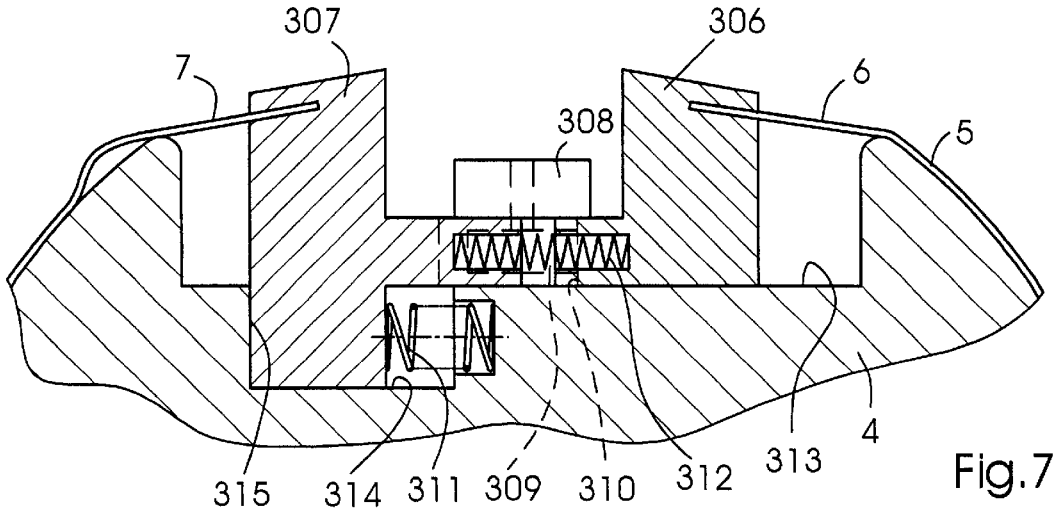
FIG. 7 is a view like that of FIG. 6 of the third embodiment of the lock-up device, wherein the cylinder dressing is held tightened at the trailing edge thereof and not yet tightened at the leading edge thereof.
Figure 8:
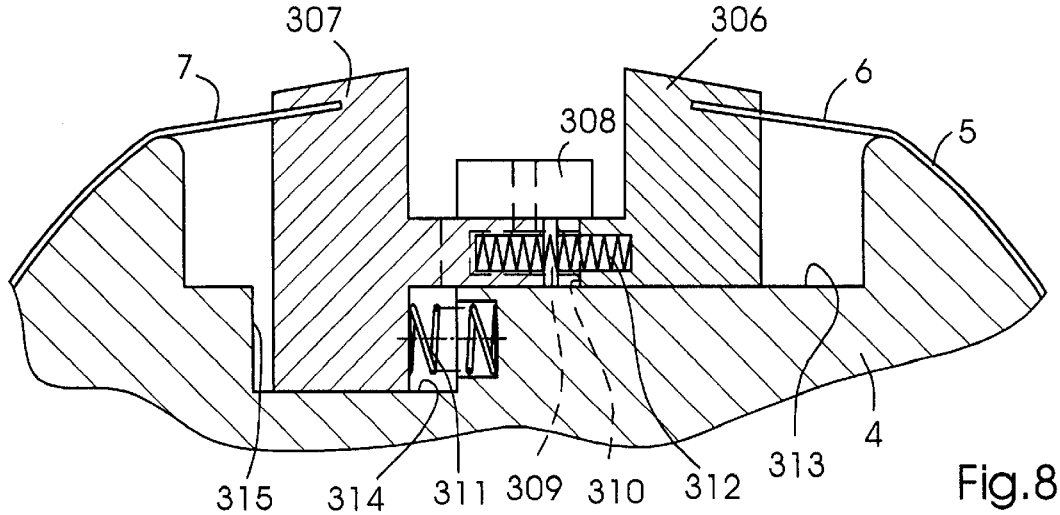
FIG. 8 is a view like those of FIGS. 6 and 7 showing the third embodiment of the lock-up device, wherein the cylinder dressing is held tightened at both leading and trailing edges thereof.

In a third exemplary embodiment of the clamping or locking device illustrated in FIGS. 6 to 8, only the features thereof which are different from those of the second exemplary embodiment of FIGS. 4 and 5 need be described, because the two clamping or locking bars 306 and 307, adjusting member 308, roller 309, thrust wedge 310 and second spring 312 correspond in construction and function substantially to the two clamping or locking bars 206 and 207, adjusting member 208, roller 209, thrust wedge 210 and second spring 212 already described hereinbefore.

The first clamping bar 306 of approximately L-shaped profile is mounted linearly displaceably on a first guide face 313 and the somewhat T-shaped second clamping bar 307 is mounted linearly displaceably on a second guide face 314. Due to the offset of the guide faces 313 and 314 in the radial direction of the printing machine cylinder 4 relative to one another and, in particular, due to the outer position of the first guide face 313 and the inner position of the second guide face 314, a helical and pressure-loadable first spring 311 can be interposed, prestressed, between the printing machine cylinder 4 and the second clamping bar 307 at a location approximately level with a stop 315 formed on or fastened to the basic cylinder body, and below the first guide face 313. In a non-illustrated embodiment, the stop 315 is adjustable in the circumferential or tautening direction for the same reasons as the stop 214. In this case, the second spring 312 does not require a higher spring constant than the first spring 311.

The locking or clamping device functions as follows:

When the adjusting member 308 is displaced in the tautening direction thereof axially parallel to the printing machine cylinder 4 and perpendicular to the drawing plane, the first clamping bar 306, with the trailing edge 6 fastened thereto, is first adjusted in a tautening direction, the first spring 311 holding the second clamping bar 307 against the frame-fixed stop 315 until the trailing edge 6 is tautened. The second clamping bar 307, together with the first clamping bar 306 which is coupled to the second clamping bar 307 via the adjusting member 308, forms a floatingly mounted locking or clamping system.

Only after a specific locking or clamping of the trailing edge 6 has been achieved does the second clamping bar 307 begin to be released from the frame-fixed stop 315 and is adjusted counter to the action of the first spring 311, so that, during the further displacement of the adjusting member 308, the leading edge 7 is tautened. At the same time, the second clamping bar 307 is adjusted in the tautening direction thereof to a considerably greater extent than the first clamping bar 306, so that in-register positioning of the print start located in the region of the leading edge 7 is provided.

I claim:

1. A method for locking a cylinder dressing on a printing machine cylinder, which comprises:

adjusting a first clamping bar for holding the cylinder dressing, and a second clamping bar for likewise holding the cylinder dressing, towards one another in respective tautening directions thereof, and performing the step of adjusting the two clamping bars by actuating a common adjusting member, so that, when locking the cylinder dressing, first, only the first clamping bar is adjusted and, second, the two clamping bars are adjusted simultaneously.

2. The method according to claim 1, which includes adjusting the two clamping bars toward one another simultaneously, while adjusting the adjusting member in an adjusting direction axially parallel to the printing machine cylinder.

3. The method according to claim 1, which includes, during tautening, holding the cylinder dressing at the trailing edge thereof by the first clamping bar and at the leading edge thereof by the second clamping bar.

4. A method for locking a cylinder dressing on a printing machine cylinder, which comprises adjusting only a first clamping bar for holding the cylinder dressing in position by actuating a common adjusting member; and subsequently simultaneously adjusting both the first clamping bar and a second clamping bar by actuating said common adjusting member.

5. The method according to claim 4, which further comprises adjusting the two clamping bars toward one another simultaneously, while adjusting the adjusting member in an adjusting direction axially parallel to the printing machine cylinder.

6. The method according to claim 5, which further comprises holding the cylinder dressing at the trailing edge thereof by the first clamping bar and at the leading edge thereof by the second clamping bar during tautening.

* * * * *